US006000561A

United States Patent [19]

Schumacher

[11] Patent Number: 6,000,561

[45] Date of Patent: Dec. 14, 1999

[54] MERCHANDISER DISPLAY

[75] Inventor: Larry Schumacher, Machesney Park, Ill.

[73] Assignee: ABC Supply Co. Inc., Beloit, Wis.

[21] Appl. No.: 09/030,686

[22] Filed: Feb. 25, 1998

[51] Int. Cl.[6] ..... A47F 5/00

[52] U.S. Cl. ..... 211/165; 211/169

[58] Field of Search ..... 211/165, 169, 211/163, 47, 48, 95, 96

[56] References Cited

U.S. PATENT DOCUMENTS

| | | | |
|---|---|---|---|
| D. 332,466 | 1/1993 | Logan . | |
| D. 334,215 | 3/1993 | Rowlands . | |
| 1,141,214 | 6/1915 | Skall | 211/165 X |
| 2,220,189 | 11/1940 | Wolters | 211/169 X |
| 3,092,256 | 6/1963 | Vernik | 211/169 X |
| 3,181,706 | 5/1965 | Mandel | 211/169 X |
| 3,478,893 | 11/1969 | Crosslen | 211/169 X |
| 3,722,699 | 3/1973 | Crosslen | 211/169 |
| 3,924,749 | 12/1975 | Weston | 211/169 X |
| 3,960,273 | 6/1976 | Weston | 211/169 X |
| 4,270,290 | 6/1981 | Eckert | 211/169 X |
| 4,320,591 | 3/1982 | Dorman . | |
| 4,490,932 | 1/1985 | McIntire . | |
| 4,702,534 | 10/1987 | Witt et al. . | |
| 5,280,840 | 1/1994 | Terpening . | |

*Primary Examiner*—Robert W. Gibson, Jr.
*Attorney, Agent, or Firm*—Keith Frantz

[57] ABSTRACT

A display unit includes multiple vertical panels that are adapted to carry and display relatively flat articles such as roofing and flooring samples. The panels are pivotally mounted for swinging generally left and right between upper and lower retaining plates which are mounted for manual rotation about a vertical axis such that each panel passes a position at the front of the unit as the retaining plates rotate through one revolution. A ratchet-type mechanism permits relatively free rotation of the unit in one direction, such as to the right, but includes equally spaced detents to interrupt free rotation of the unit each time a panel reaches said front position. The panels are biased to swing toward, in the present instance, the right, such that the front of each panel is presented in a forwardly direction when that panel is positioned at the front of the unit. A stop mechanism is positioned to engage the panel that is approaching the position preceding said front position, and is adapted cause that panel to swing, in the present instance, to the left, such that the back of that panel is presented in a forwardly direction when it reaches said preceding position, and such that a person viewing the front of the merchandiser will see the front of the panel in the front position and the back of the panel in the preceding position.

13 Claims, 8 Drawing Sheets

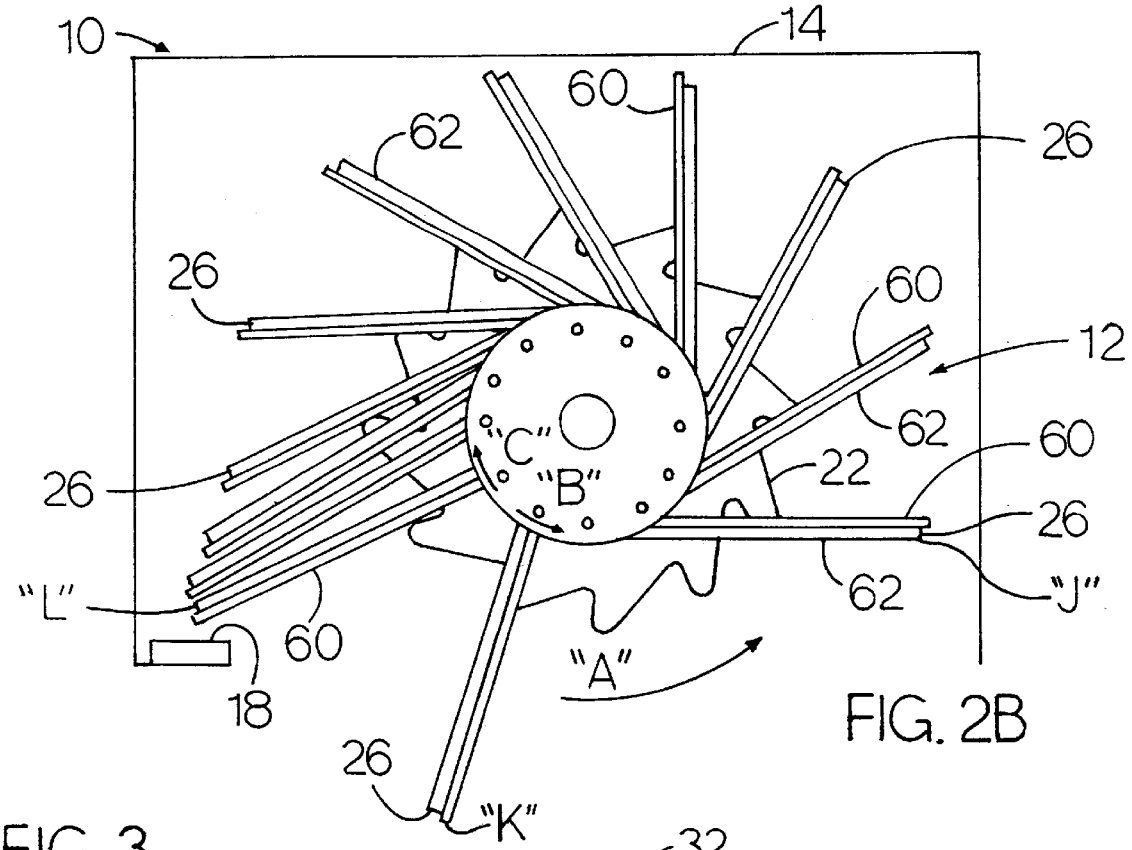
FIG. 2B
FIG. 3
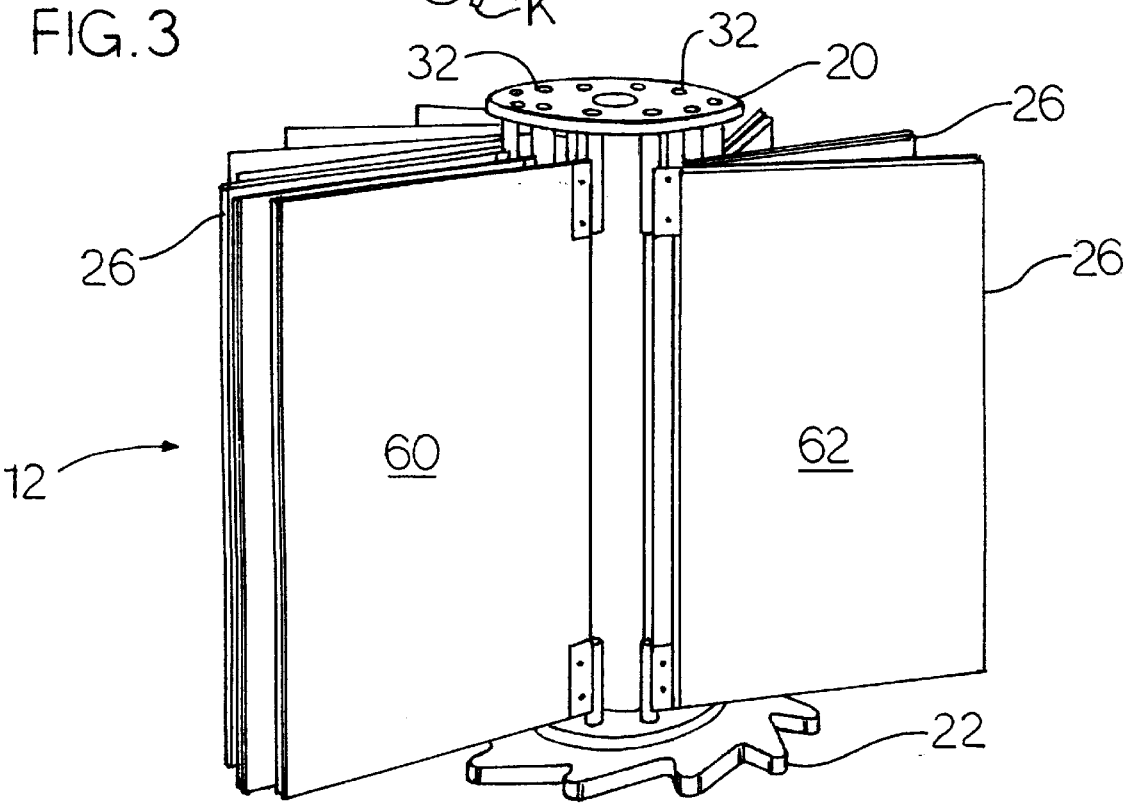

FIG. 8A
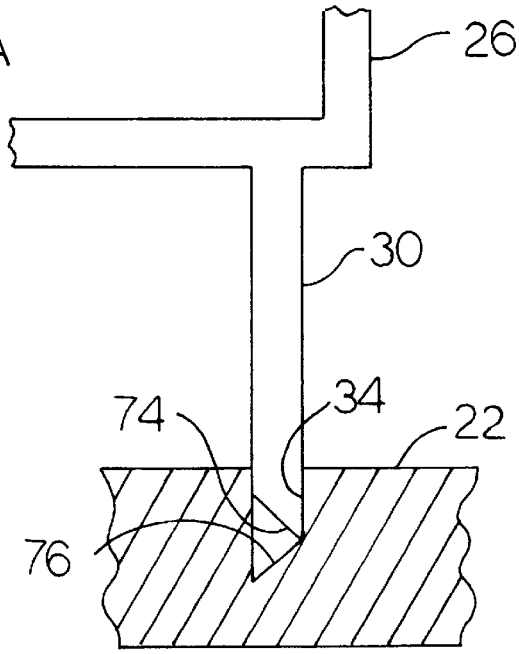
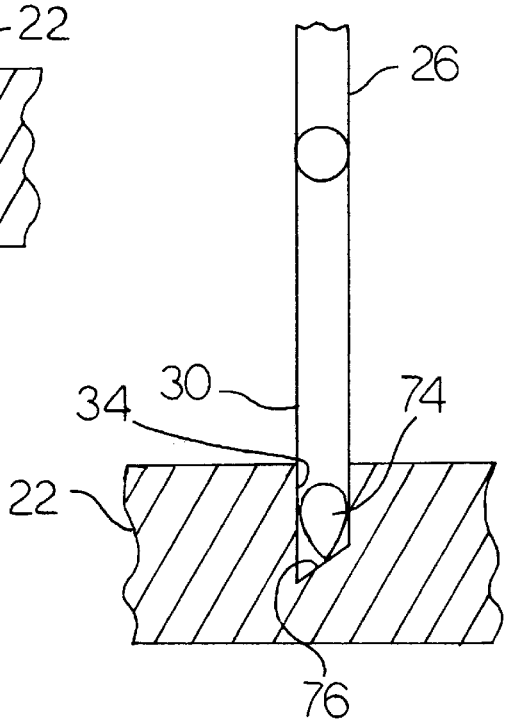
FIG. 8B
FIG. 8C
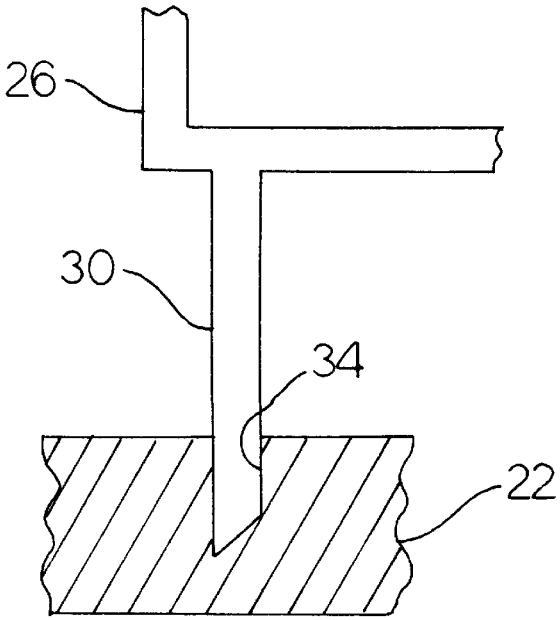

MERCHANDISER DISPLAY

BACKGROUND OF THE INVENTION

This invention relates generally to display units, and more particularly to display units which, while suitable for other purposes, are particularly useful in a retail or wholesale store or show room for displaying a variety of samples of relatively flat articles that are typically sold in bulk or large quantity such as roofing and flooring materials from which a consumer may choose.

One prior method of displaying floor samples such as carpeting includes mounting the carpet samples to a frame in an overlapping manner, with one sample mounted below the next, such that a particular sample may be viewed in full by lifting the samples mounted above it. However, such an arrangement is not generally suitable for certain materials such as ceramic tile or roofing samples.

A prior method that is used with samples such as linoleum is to simply slip the samples in a rack such that the any sample can be viewed in full by removing the sample from the rack. However, again this arrangement is not generally suitable for certain materials such as roofing samples which tend to be relatively heavy and not easily slipped into and out of a rack.

Another prior apparatus for displaying flooring samples includes the use of flip-type panels that are mounted in a frame along a wall. In such an arrangement, the panels overlap one another, and are mounted for swinging left and right such that any sample may be viewed in full by swinging the adjacent panels off of the panel carrying the sample to be viewed. Such an arrangement, however, requires substantial floor space and requires the customer to walk along the display to view the entire set of samples.

One prior arrangement for displaying merchandise such as posters includes the use of a rotating display. In this instance, the posters are displayed in panels that are mounted in a circular pattern in a rotatable frame. The panels are connected for swinging left and right, and are generally biased to a neutral position extending radially from the center of the frame. The entire set of posters on the display may be viewed from a single location by turning the display. Again, however, in order to view an entire poster, the adjacent posters must be swung out of the way, and in this instance, held in that position by the customer. Such an arrangement also requires substantial floor space since the panels extend radially outward, and since the posters may be viewed in any location around the display.

The nature of asphalt roofing, that is, its tendency to break if repeatedly bent, generally requires that samples be mounted to a board for viewing. For the reasons discussed above, and due to the nature of such samples and the relatively large number of samples available, none of the above methods has been extensively accepted in the roofing industry. Instead, roofing samples are typically stored on a collection of loose boards that may, if desired, be carried to a job site for further viewing. In those outlets that do have fixed displays of roofing samples, the samples are typically displayed by simply securing the samples along a wall in the showroom. This method, however, again requires substantial space if a relatively large selection of samples is to be displayed since, particularly since the entire sample must be exposed for viewing.

Thus, there is a need for an apparatus adapted display all types of merchandise samples of the general type discussed above, including roofing samples, and which is further adapted to display a relatively large selection of such samples in a relatively small space in a showroom or merchandise outlet, thus freeing up the space for other purposes such as the display of additional merchandise. Moreover there is an ever present need for displays that enhance merchandising and that aid the customer in the selection of a particular sample.

SUMMARY OF THE INVENTION

The general aim of the present invention is to provide a new and improved merchandising unit for displaying a selection of asphalt roofing materials, ceiling materials, ceramic tiles, flooring materials, and like articles for viewing by a consumer, the unit being capable of carrying a relatively large selection of samples from which to select in less small floor space than prior arrangements, the unit being further adapted for enhanced merchandising of the samples.

A detailed objective is to achieve the foregoing by providing a rotatable display that is adapted to carry a large selection of samples, but which is further adapted such that a selected number of samples may be viewed at a time.

Another detailed objective is to display, for example, a photograph showing the samples being viewed as they might appear when installed to aid the customer in visualizing the sample as installed, or to display other information such as information about the samples being viewed or information on related merchandise.

These and other objectives and advantages of the invention will become more apparent from the following detailed description when taken in conjunction with the accompanying drawings.

In general, the display unit of the present invention includes vertical panels that carry the material samples for display, and that are connected between upper and lower retaining plates in a circular pattern and for swinging back and forth between the plates. The plates are, in turn, mounted on a pole for rotation of the panels about a vertical axis. A housing generally surrounds the unit, but is provided with an open front such that unit may be manually rotated for viewing the samples as the panels pass the front of the display.

In accordance with the present invention, the display unit is uniquely adapted for viewing a limited number of samples at a time, and for simultaneously displaying information related to the samples being viewed, such as a photograph of the samples as installed or other graphics. More specifically, the unit is uniquely adapted for viewing only the front of one panel and the back of the following panel at any one time, the material samples being mounted to the fronts of the panels and the corresponding photographs or information being mounted to the backs of the panels following the associated samples.

In carrying out the invention, the panels are biased to swing in one direction, such as to the right when viewed from the front of the unit, and to a predetermined position such that the front of the panel, and thus the samples thereon, face generally forwardly when that panel is located at a front position at the front of the unit. In addition, the housing is equipped with a stop that is adapted to engage each panel, in turn, as the unit is rotated, and specifically, to engage the panel just following the panel that is located at the front of the unit. The stop is further adapted to cause the engaged panel to swing to the left as the unit rotates to the right, thus exposing the back side of that panel in a forwardly facing direction adjacent the panel with the exposed samples. As the unit is rotated further, that panel disengages from the stop, and automatically swings to the right such that the front of that panel faces forwardly upon reaching the front of the unit. This action repeats for each of the panels as the unit is rotated through 360 degrees.

Advantageously, the unit is equipped with a ratchet-like, detent stop mechanism that is adapted to generally prevent rotation, in this instance, to the left, and that interrupts or stops free rotation of the unit to the right each time a panel reaches the front of the unit, but that is easily overcome for advancing the unit to display the next panel. Thus, the samples on each panel and the information related to such samples is, in turn, automatically presented for viewing by simply turning the unit from one detent stop to the next.

BRIEF DESCRIPTION OF THE DRAWINGS

FIGS. 2A and 2B are top views of a merchandiser of FIG. 1, and showing the merchandiser in a stationary position and in an intermediate position between stationary positions, respectively.

FIG. 3 is an enlarged perspective view of certain parts of the merchandiser as seen without the housing.

FIGS. 8A–C are enlarged cross-sectional views taken substantially along the line 8—8 of FIG. 4 and showing the transition of a panel leg as the panel moves from a first position through said intermediate position to a second position.

Figure 1:
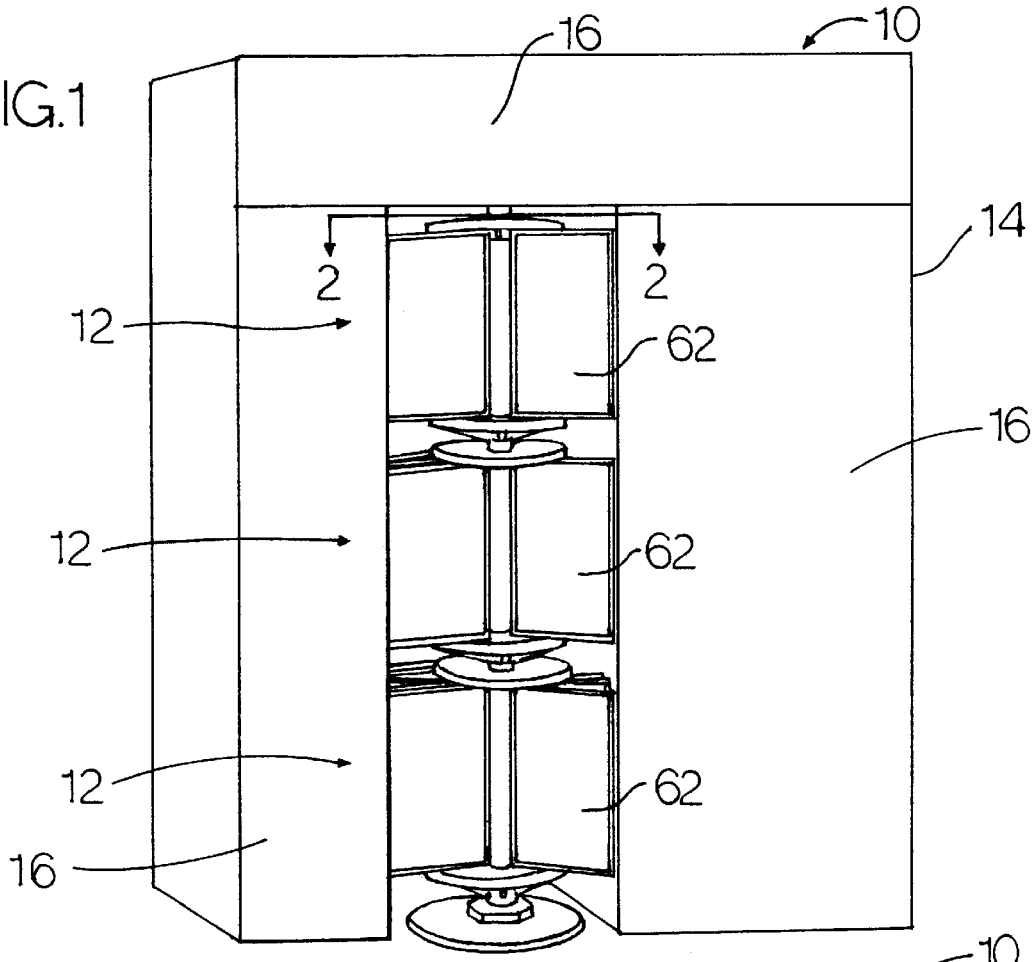
FIG. 1 is a perspective view of three stacked merchandising units in a single housing, each unit having multiple panels for displaying merchandise samples and incorporating the unique aspects of the present invention.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

For purposes of illustration, the present invention is shown in the drawings as embodied in a merchandiser 10 (FIG. 1) adapted to display a selection of relatively flat articles such as asphalt roofing samples 62, flooring samples such as carpeting or tile, or like products.

Figure 4:
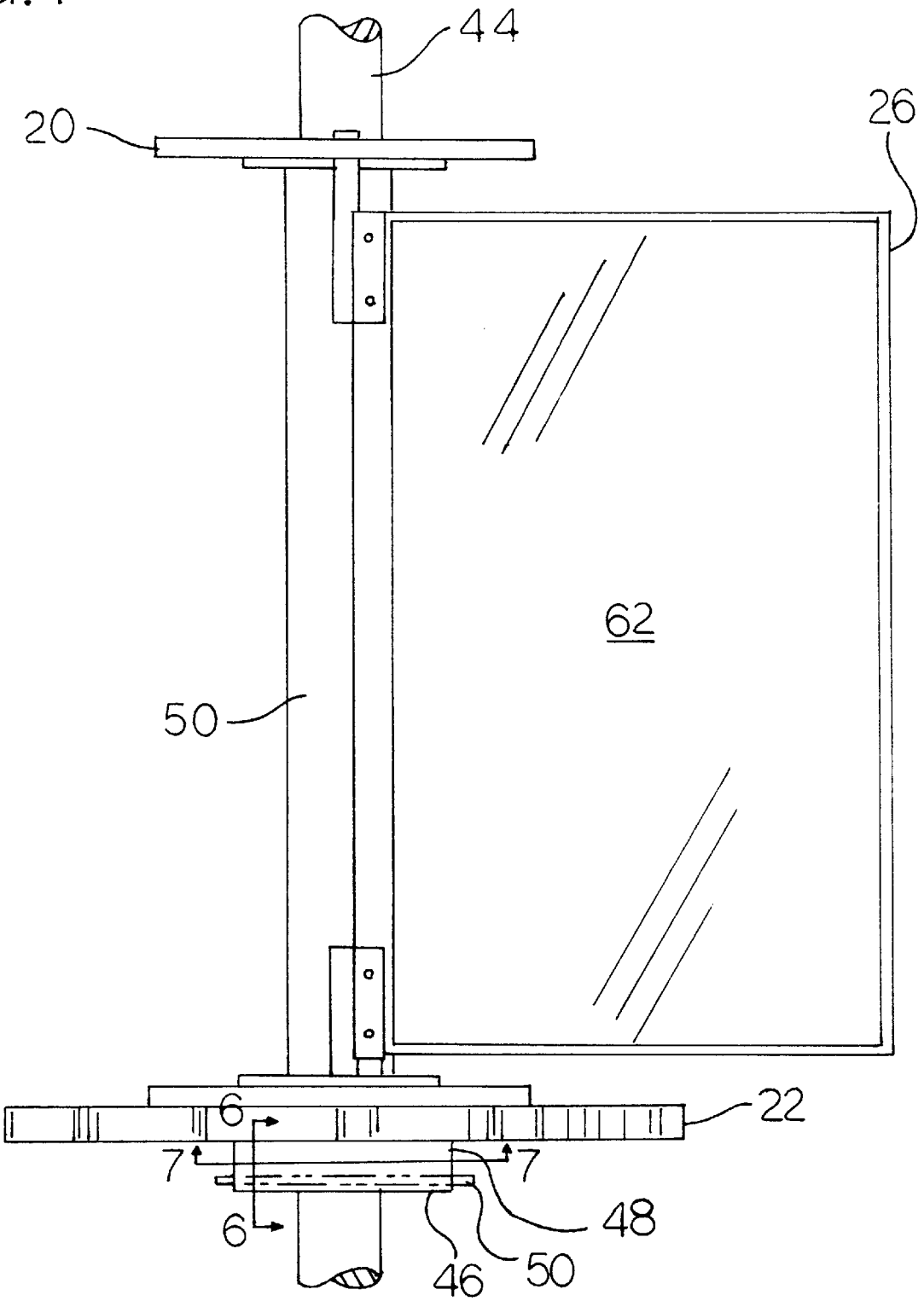
FIG. 4 is an enlarged front view of a single panel installed the merchandiser.

In general, the merchandiser includes a display unit 12 having multiple panels 26 (FIG. 2) that carry the roofing samples 62 and that are mounted between upper and lower horizontal plates, 20 and 22, respectively. The plates are formed with centrally located openings sized to slip over a pole 44 that is supported in an upright position such that the plates are rotatable about a vertical axis extending through the center of the pole. A sleeve 24 (FIG. 4) is positioned on the pole between the upper and lower disks to establish the distance between the plates and such that the weight of the upper plate transfers to the lower plate. The lower plate includes an integral lower portion 48 that rests on a base member 46 which is also slidably positioned on the pole. The base member 46 is positioned and retained on the pole by a retaining pin 50 that is snugly received through aligned horizontal openings formed through the base member and the pole. The lower portion 48 of the lower plate is then supported for rotation on the base member with a conventional thrust-type bearing assembly 70 positioned therebetween (see FIG. 6).

The panels 26 are mounted in a vertical orientation between the plates 20 and 22 for rotation therewith about the pole 44. To this end, each panel 26 includes upwardly and downwardly projecting post, 28 and 30, respectively, extending from one side or edge of the panel. The posts 28 and 30 are then slidably received into openings 32 and 34 formed in the upper and lower plates, 20 and 22, respectively, to provide for back and forth, or left and right, swinging of the panels. The openings 32 and 34 are located in a circular pattern that is concentric with the center of the plates. With this arrangement, the samples 62 on each of the panels can be viewed by simply rotating the unit 12 such that each panel moves, in turn, past the front of the unit.

The plates 20, 22, the sleeve 24, the spacers 36, 40 with integral thrust washers 38, 42, respectively, and the lower base member 46 may be made from any suitable material such as molded plastic or structural foam material. Additionally, these members may be optionally connected together with an adhesive or glue adapted for such materials. In this instance, the panels 26 are sized to be installed by positioning the lower post 30 in a recess of the handles formed on the lower plate 22, slipping the upper post 28 into an opening 32 in the upper plate, and then slipping the lower post into an associated opening 34 in the mower plate, removal of the panel be the reverse procedure. In the event that the lower plate is formed without the integral handles and associated recesses, an additional set of holes that are concentric with and outwardly of the openings 34 may be formed in the lower plate for the same installation and removal purpose.

Figure 5:
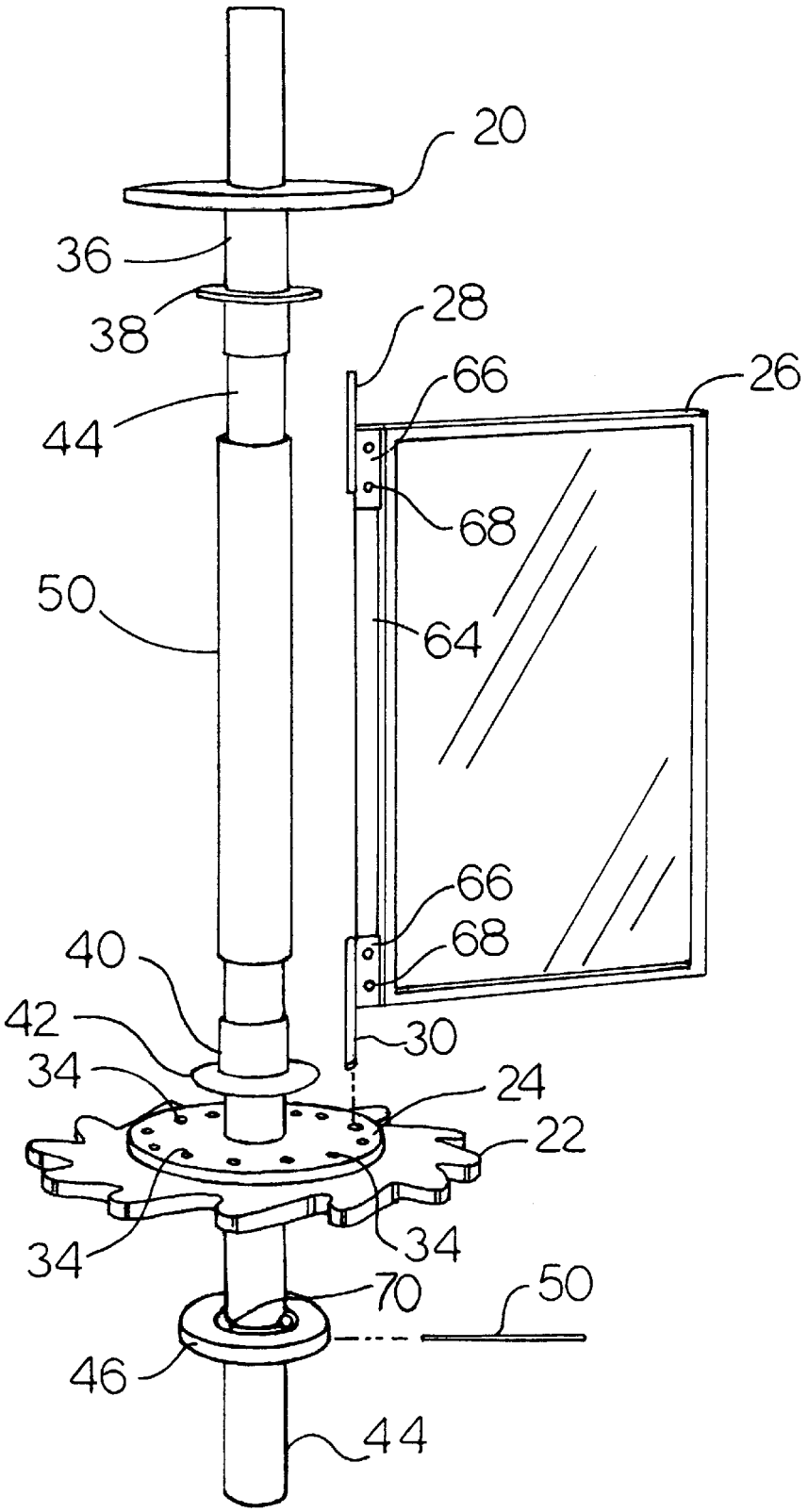
FIG. 5 is an exploded perspective view of the parts shown in FIG. 4.

The construction of the panels 26 may take a variety of convenient forms. In the embodiment shown, the upper and lower posts 28, 30 are each integrally formed with a clip 66. The clips are then connected to a spine portion 64 of the panel with fasteners 68. The panel may optionally be provided with a frame (see FIG. 5) either for decorative purposes or to assist in holding the sample to the panel.

In the embodiment shown, the merchandiser 10 includes three identical display units 12 that are stacked one on top of another and are mounted for independent operation. Thus, each of the units is positioned on the pole 44 with separate base members 46 and pins 50, such that each unit is independently rotatable and the weight of each unit is carried by it respective base member and pin.

In accordance with the present invention, the merchandiser 10 is uniquely adapted to display a limited number of roofing samples 62 at any one time, and to display photographs 60 or information regarding those samples for consideration by a customer that is viewing the samples presented, or to suggest related products that will be needed in connection with the installation of the products. Photographs, for example, may show the samples as they appear installed on the roof of a home. As a result, a consumer is better able to focus on and consider the samples presented, to visualize what the style(s) and/or color(s) of the sample(s) presented would look like on his or her home, and to consider the other factors presented regarding the prospective purchase. Advantageously, and as will become apparent, such arrangement also enables the samples to be organized for viewing by, for example, grade, color, and styles to further assist the customer.

More specifically, the merchandiser 10 is uniquely adapted to present only the front of one panel 26 and the back of an adjacent panel on a unit at any one time for viewing, the samples 62 being mounted to the fronts of the panels, and the associated photographs 60 or information being mounted to the backs of the panels following the respective samples.

Figure 2A:
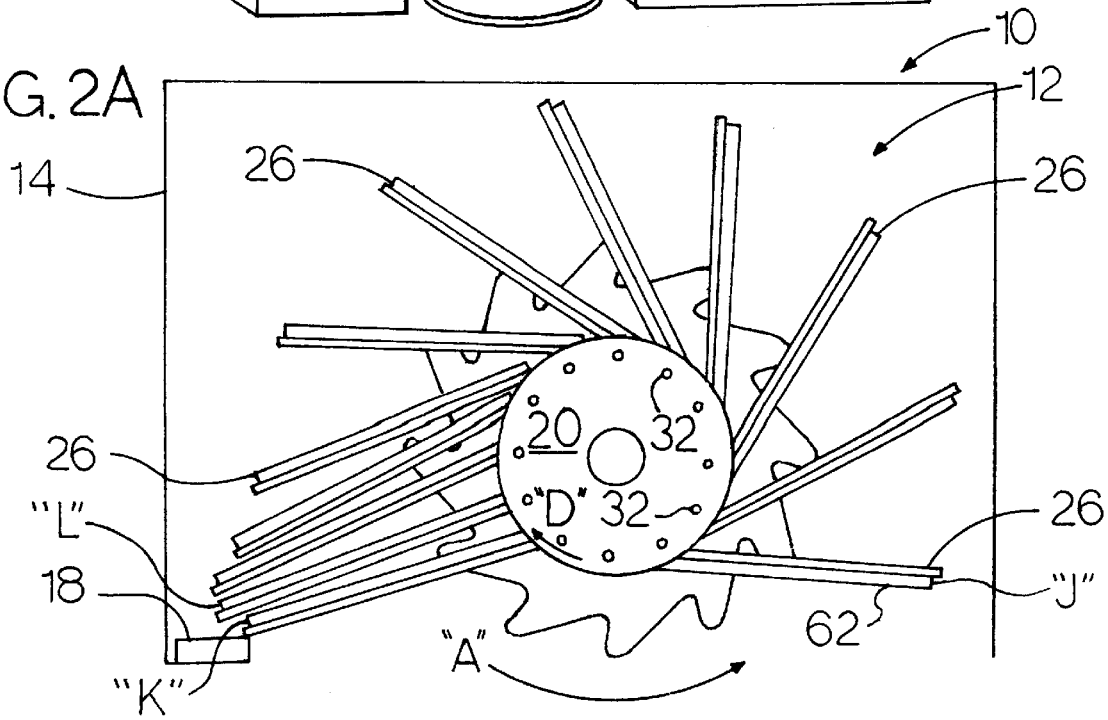

In carrying out the invention, the panels 26 are biased to swing in one direction, such as to the right in the embodiment shown, when viewed from the front of the merchandiser 10, (i.e., in a counter-clock wise direction about the posts 28, 30 when viewed from above such as in FIG. 2A), and are mounted to swing through a rotation of approximately 180 degrees such that the panels are biased to swing to a predetermined angle with respect to the circular diameter on which the panels are mounted in the plates 20, 22. As can be seen in FIG. 2A, in the present instance, the panels on the right half of the unit are shown in the biased position that is substantially tangent to the circular diameter on which the panels are mounted, the "front" panel being identified as "J". Thus, each panel is biased such that the front of the panel, and thus the sample 62 thereon, faces generally forwardly when that panel is located at a predetermined location in the revolution of the unit, and in the present instance, when the panel is located generally at the front of the unit. The display unit is located in a housing 14 which generally surrounds the display unit, but is open at the front for viewing of the samples on the front panel. Advantageously, additional merchandising graphics and information may be displayed on the walls of the housing without requiring additional floor space.

In keeping with the invention, the merchandiser 10 is equipped with a stop 18 that extends along the left side of the housing 14, and is adapted to engage each panel 26, in turn, as the unit 12 is rotated, and specifically to engage the panel following the panel at the front of the unit 12. The stop 18 is positioned to interrupt and counteract the biasing force on the panels, and to cause the panels approaching the front the unit to swing from the biased position and to the left as the unit is rotated in the counter-clockwise direction. As a result, the back of that panel faces in a generally forwardly direction. Thus, as shown in FIG. 2A, the front of one panel "J" is presented for viewing on the right side of the unit, and the back of the next panel "K" is presented for viewing on the left side of the unit.

In an alternate embodiment (not shown) the stop 18 is fixed stationary to an alternate stationary "ground" such as connected to a pole that is fixed against rotation relative to the unit 12. In this instance, for example, an arm may extend radially outwardly from the pole 44, above or below the panels, and include a stop portion adapted to restrain rotation of panels as otherwise provided for herein. Such an arrangement permits the unit 12 to be free-standing without a housing. In still another alternate embodiment, the pole of such a free standing unit is adapted to be rotated for selective placement of the "front" of the unit, the front being that position presenting the front of one panel and the back of the following panel as described, the pole for being releasably stationary at any such position.

Whereas the unit 12 may be considered to be in a stationary position in FIG. 2A for viewing of the sample on panel "J", the operation of the unit may be more fully understood by considering both FIGS. 2A and 2B, FIG. 2B illustrating the unit in a transition position, and being rotated for the purpose of viewing the sample on the panel "K".

As the unit 12 is rotated to the right from the position illustrated in FIG. 2A, the holes 32, 34 and the posts 28, 30 associated with the panel "K" also rotate to the right, whereas panel "K" itself swings in a clockwise direction about the posts as indicated by the arrow "D" as a result of the interruption of rotation or restraint on movement of the free end of the panel "K" imposed by the stop 18. Simultaneously, the free end of the panel "K" is drawn toward the right edge of the stop until the panel is eventually released from engagement with the stop. As a result of being biased for counter-clockwise swinging, the panel "K" then automatically swings toward the right as indicated by arrow "B" in FIG. 2B until reaching its substantially tangential position discussed above. At the same time, the next panel "L" engages the stop 18 and, as indicated by arrow "C" swings further to the left. Finally, as the unit continues to be rotated, panel "K" assumes the front position previously held by panel "J" as shown in FIG. 2A, and panel "L" assumes the position of panel "K" shown in FIG. 2A. With this arrangement, the front of each panel is presented facing forwardly, in turn, as the unit rotates, with the back of the next panel being simultaneously presented.

The panels 26 may be biased to swing toward the substantially tangential position discussed above, and in the present instance toward the right, by any suitable technique such as with the use of a conventional coil spring engaged between, for example, the lower plate 22 and the lower post 30.

Alternately, the panels 26 of the embodiment shown are biased from a cam action that takes advantage of gravity and the weight of the panels. To this end, the bottoms 74 (FIG. 8A) of the posts 30 are formed at an angle from horizontal such as approximately 45 degrees, and the openings 34 in the lower plate 22 are formed with a bottom surface 76 that is formed at the same angle.

With this in mind, FIGS. 8A-C illustrate the approximately 180 degree range of swinging movement of the panels 26 in the unit 10. Specifically, FIG. 8A illustrates the approximate position of the panel "K" of FIG. 2A just prior to disengaging from the stop 18. FIG. 8B illustrates the position of panel "K" as generally shown in FIG. 2B after the panel has disengaged from the stop 18 and is swinging toward the right, and FIG. 8C corresponds to the position of the panel in the "front" position such as the position of panel "J" of FIG. 2A. Thus, it is apparent that the weight of the panels causes them to automatically rotate "down" the surface 76, assuming movement of the panel is not restrained by the stop 18, and biases the panel to the right and toward the position shown in FIG. 8C.

When considered from the opposite view point, it is also apparent that a panel 26 begins in the neutral biased position of FIG. 8C when approaching the stop 18, and the post 30 "climbs" up the surface 76, thus raising the panel, as the panel rotates nearer the stop 18. In short, as the unit rotates, the bottom of the post 30 climbs up the angled surface 76 as the panel engages the stop 18, and when the panel passes the stop, the frame swings to the right as it rides down the surface 76 due to gravity so that the front of the panel is presented for viewing.

Figure 9:
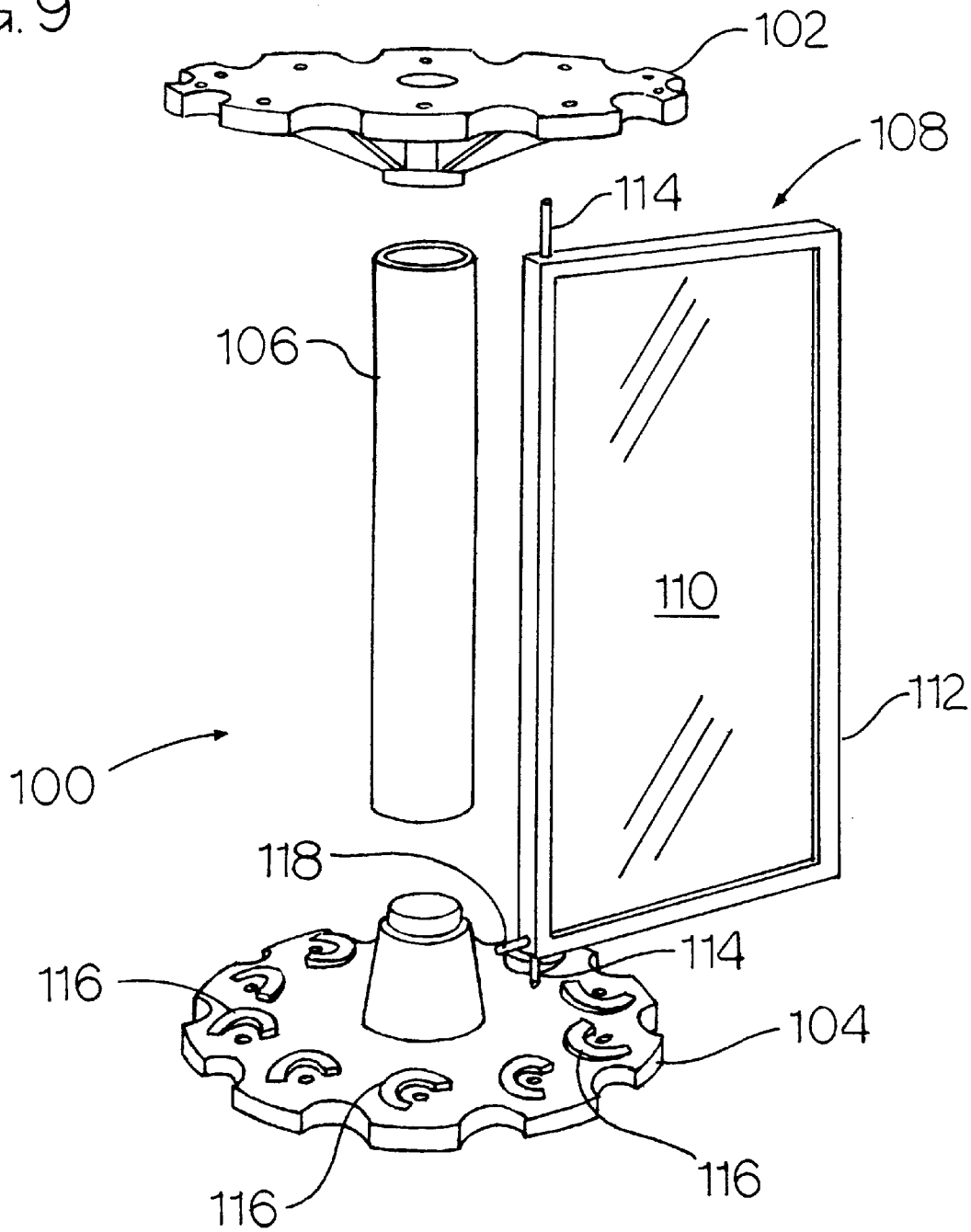
FIG. 9 is an exploded perspective view of an alternate embodiment of certain parts of the merchandiser.

In an alternate embodiment of the unit 12 (FIG. 9), the internal cam arrangement between the base of the post 30 and the base 22 is replaced with a cam arrangement that is located externally on the base. Specifically, the alternate unit 100 includes upper and lower plates 102 and 104, respectively, and a sleeve 106 disposed in supporting relation therebetween. The panels 108 adapted to carry the sample 110 and including a frame 112, are mounted for swing with upper and posts 114 slidably received in openings in the plates. In this instance, horizontally extending posts 118 are adapted to slidably engage crescent-shaped ramps 116 for effecting gravitational biasing of the panels toward the right. The other aspects of this alternate embodiment remain essentially the same as the embodiment otherwise shown and described herein.

In carrying out another aspect of the invention, the unit 10 is equipped with a ratchet-like arrangement that generally allows for free rotation of the unit to the right, but which stops such free rotation each time a panel moves into position at the front of the unit, and which can be manually overcome by continuing to push the unit to the right, the arrangement being further adapted to prevent rotation toward the left upon reaching the position in which a panel is presented for viewing, thus providing for relatively easy operation of the unit by the consumer.

Figure 6:
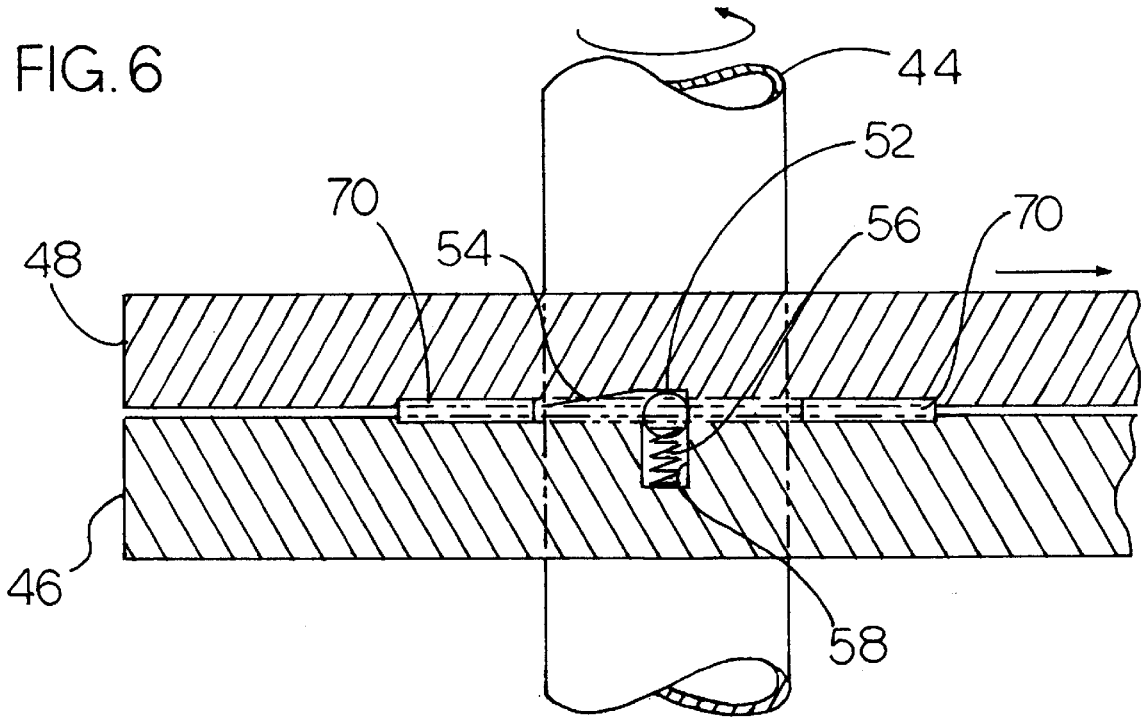
FIG. 6 is an enlarged cross-sectional view taken along the line 6—6 of FIG. 4.
Figure 7:
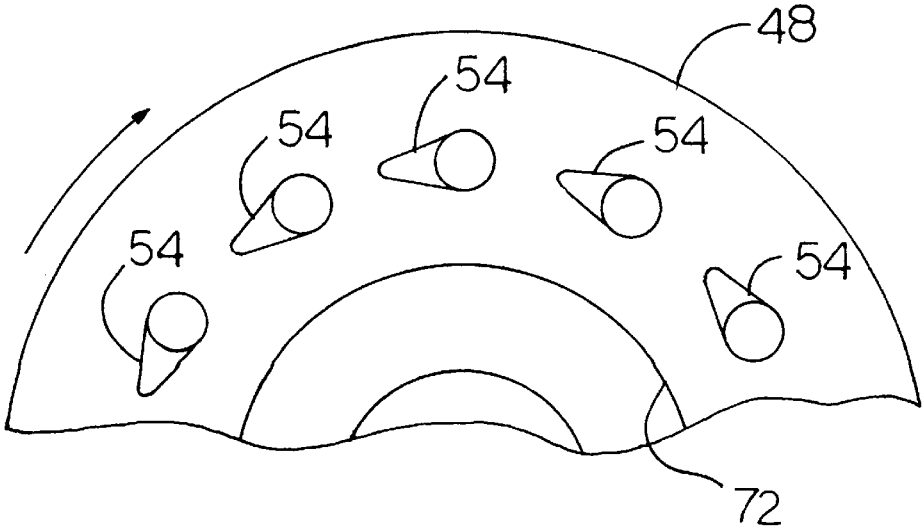
FIG. 7 is a view taken substantially along the line 7—7 of FIG. 4.

In the embodiment shown, a relatively simple ball-detent arrangement is utilized for the purpose of controlling the rotation of the unit in the desired direction. Specifically, at least one ball 52 (FIG. 6) is slidably positioned in a counterbore 58 formed in the base member 46, and is spring biased upwardly toward the lower portion 48 of the lower plate 22, the number of balls used being determined, in part, on the rotation-stopping forces desired, and the desired ease or difficulty for overcoming such forces. Downwardly facing detent-stop counterbores 54, twelve in the present instance, are formed in the lower portion of the lower plate, and are equally angularly spaced on a diameter to coincide with the radial distance from the center of the pole 44 to the ball 52. Thus, as the unit is rotated through one revolution, the ball will spring into a detent-counterbore once for each of the panels in the unit, for stopping the free rotation of the unit each time a panel is positioned with its front facing forwardly. Preferably, the detent-counterbores are formed with a lead-in side having a relatively sharp corner such that, once the ball is positioned in the counterbore, reverse rotation of the unit is prevented. On the other hand, the trailing side of the detent-counterbore is formed with a ramp such as shown in FIGS. 6 and 7, to aid in resuming rotation of the unit to the right when desired by allowing the ramp to drive the ball gently into the counterbore 58, thus allowing for free rotation of the unit until the next detent-stop is reached.

Figure 10B:
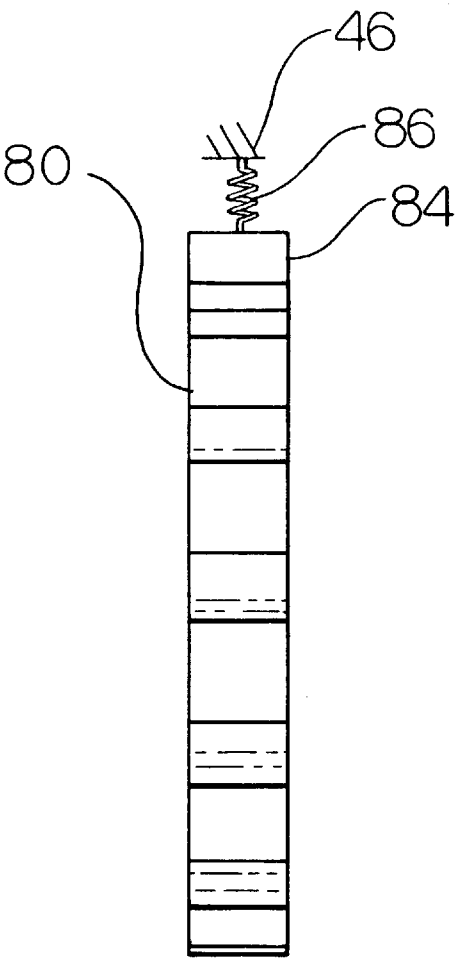
FIGS. 10A and 10B are top and side views, respectively, of an alternate ratchet-like arrangement.
Figure 10A:
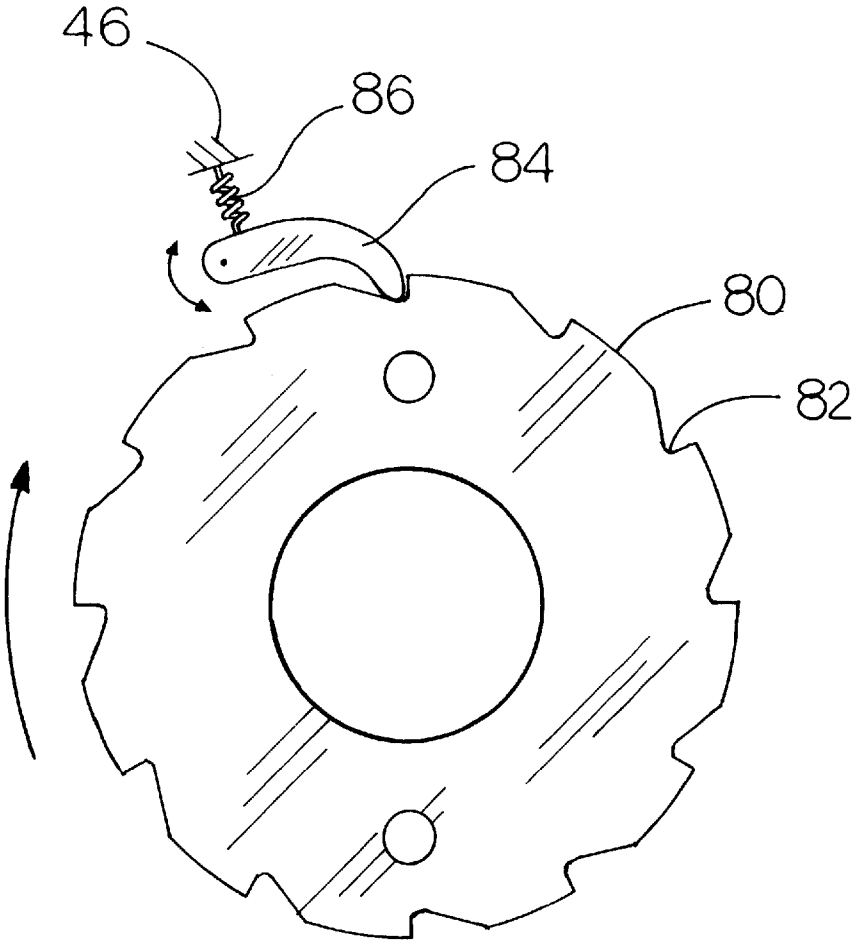

A more conventional ratchet-like arrangement is shown in FIGS. 10A and 10B. In this instance, the wheel 80 is connected for rotation with the lower plate 22, the lever 84 is pinned to the base 46 for swinging inwardly and outwardly with respect to the wheel, and a spring 86 connected to the base 46 biases the front of the lever toward the wheel. The wheel rotates in the direction indicated as the unit 12 is turned to the right, and the lever 84 swings into engagement with detents formed in the wheel each time a panel is located at the front of the merchandiser for viewing. Thus, the lever permits rotation of the wheel to the right, but prevents rotation of the wheel to the left from the detent positions.

It is apparent that a single or multiple samples may be located on each panel, and associated photograph(s) or other information be located on the backs of the associated following panels, thus providing for a display adapted to aid in organizing samples according to colors, styles, or other criteria. Advantageously, the information displayed on the backs of the panels can include information on related products that may be needed, such as in the present instance, for a roofing job.

From the foregoing, it will be apparent that the present invention brings to the art a new and improved merchandiser 10 that is uniquely adapted for enhanced merchandising of roofing, flooring and like samples 62 and related merchandise to assist a customer in the purchasing decisions of such products, and is adapted to offer for viewing a relatively large number of samples in substantially less floor space than prior arrangements utilized for the same general purpose, by providing panels 26 biased to a predetermined position for displaying the front of one panel and by providing means for interrupting and counteracting such biasing for displaying the back of the following adjacent panel. More specifically, by virtue of biasing the panels 26 to a position that is substantially tangent to the diameter of rotation of such panels in the unit 12, and providing a stop 18 adapted to engage the panels for swinging in the opposite direction, the merchandiser 10 is uniquely adapted to automatically present the front and the back of adjacent panels for simultaneous viewing, and to the exclusion of the remainder of the panels in the merchandiser. Moreover, a ratchet-like arrangement insures that the panels to be viewed are automatically positioned in and oriented facing forwardly at the front of the merchandiser.

I claim:

1. A display unit comprising:

(A) a base mounted for rotation in a first direction about a vertical axis and through a first location;

(B) a plurality of panels having first and second end portions;

(C) means connecting said panels to said base (i) for rotation of said panels with said base and (ii) for swinging of said panels independently of said base between first and second positions;

(D) means for biasing said panels toward said first position; and (E) stop means (i) engaging said panels, in turn and one panel at a time, and (ii) preventing rotation of the second end portion of said one panel until the first end portion of said one panel has rotated to said first location, whereupon said one panel disengages from said stop means and begins to swing toward said first position.

2. A display unit as defined in claim 1 in which (i) said first end portions are connected to said base, (ii) said second end portions extend generally outwardly from said base, and (iii) said stop means slidably engages said second end portions.

3. A display unit as defined in claim 1 in which said first end portions are connected to said base in a generally circular pattern that is concentric with said axis, and in which said panels extend substantially tangent to said circular pattern when in said first position.

4. A display unit as defined in claim 1 in which said panels have front and back portions, and in which the back portion of said one panel and the front portion of an adjacent panel are presented for simultaneous viewing while said one panel engages said stop means.

5. A display unit as defined in claim 1 further comprising ratchet-like means for interrupting free rotation of said base once for each panel of said plurality of panels during rotation of the base through 360 degrees.

6. A display unit as defined in claim 1 in which said biasing means includes a plurality of inclined cam surface portions connected to said base and positioned generally below said panels for sliding engagement therewith such that said cam surfaces portions cooperate with the weight of the panels to bias said panels to said first position.

7. A display unit comprising:

(A) a base mounted for rotation in a first direction about a vertical axis and through a first location;

(B) a plurality of panels having first and second end portion;

(C) means connecting said panels to said base (i) for rotation of said panels with said base and (ii) for swinging of said panels independently of said base between first and second positions;

(D) means for biasing said panels toward said first position; and (E) means (i) for engaging said panels, in turn and one panel at a time, and (ii) for simultaneously swinging said one panel toward said second position as said base rotates until the first end portion of said one panel has rotated to said first position, whereupon said panel disengages from said engaging and swinging means.

8. A display unit as defined in claim 7 in which said the second end portion of said one panel (i) slidably engages said engaging means, and (ii) is drawn generally in said first direction until the first end of said one panel reaches said first position.

9. A display unit as defined in claim 7 in which (i) said first end portions are connected to said base, (ii) said second end portions extend generally outwardly from said base, and (iii) said stop means slidably engages said second end portions.

10. A display unit as defined in claim 7 in which said first end portions are connected to said base in a generally circular pattern that is concentric with said axis, and in which said panels extend generally in said first direction when in said first position.

11. A display unit as defined in claim 7 in which said panels have front and back portions, and in which the back portion of said one panel and the front portion of an adjacent panel are presented for simultaneous viewing while said one panel engages said stop means.

12. A display unit as defined in claim 7 further comprising ratchet-like means for interrupting free rotation of said base once for each panel of said plurality of panels during rotation of the base through 360 degrees.

13. A display unit as defined in claim 7 in which said biasing means includes a plurality of inclined cam surface portions connected to said base and positioned generally below said panels for sliding engagement therewith such that said cam surfaces portions cooperate with the weight of the panels to bias said panels to said first position.

* * * * *